US006769517B2

(12) United States Patent
Schmied et al.

(10) Patent No.: US 6,769,517 B2
(45) Date of Patent: Aug. 3, 2004

(54) SUSPENSION FOR A RAIL BRAKE

(75) Inventors: Lothar Schmied, Wetter (DE); Matthias Kastner, Vienna (AT)

(73) Assignee: Knorr-Bremse Systeme fur Schienenfahrzeuge GmbH, Munich (DE)

( * ) Notice: Subject to any disclaimer, the term of this patent is extended or adjusted under 35 U.S.C. 154(b) by 4 days.

(21) Appl. No.: 10/220,127

(22) PCT Filed: Feb. 28, 2001

(86) PCT No.: PCT/EP01/02197

§ 371 (c)(1),
(2), (4) Date: Dec. 12, 2002

(87) PCT Pub. No.: WO01/64495

PCT Pub. Date: Sep. 7, 2001

(65) Prior Publication Data

US 2004/0079597 A1 Apr. 29, 2004

(30) Foreign Application Priority Data

Feb. 28, 2000 (DE) ..... 100 09 270

(51) Int. Cl.[7] ..... F16D 65/34
(52) U.S. Cl. ..... 188/165; 105/77
(58) Field of Search ..... 188/50–55, 165; 105/77–78

(56) References Cited

U.S. PATENT DOCUMENTS

| | | | | |
|---|---|---|---|---|
| 3,723,795 A | | 3/1973 | Baermann | |
| 3,805,927 A | | 4/1974 | Tolksdorf | |
| 3,840,096 A | | 10/1974 | Tolksdorf | |
| 3,897,117 A | * | 7/1975 | Katzer | 384/40 |
| 3,995,724 A | * | 12/1976 | Katzer | 188/165 |
| 4,109,934 A | * | 8/1978 | Paton et al. | 280/124.177 |
| 4,144,954 A | | 3/1979 | Farello et al. | |
| 5,647,458 A | | 7/1997 | van der Sloot et al. | |
| 6,247,413 B1 | * | 6/2001 | Teichmann | 105/199.1 |

FOREIGN PATENT DOCUMENTS

| | | |
|---|---|---|
| DE | 883 293 | 7/1953 |
| DE | 317 290 | 8/1974 |
| DE | 24 18 636 | 10/1975 |
| FR | 2 098 116 | 3/1972 |

* cited by examiner

*Primary Examiner*—Christopher P. Schwartz
(74) *Attorney, Agent, or Firm*—Barnes & Thornburg LLP

(57) ABSTRACT

The invention relates to a suspension for a rail brake on a bogie of a rail vehicle. A passive lifting device is provided which acts upon the rail brake according to the activation state thereof in such a way that said brake can be displaced between a lowered braking position and a lifted release position. In the release position, damping elements act between stoppers of the rail brake and the carriers of the bogie in such a way that transverse forces are reliably damped by virture of vibration or impact loads for instance. In the braking position, the lateral play required in said position is provided. The spring characteristics of the damping elements are configured in such a way that the two requirements can be met.

17 Claims, 3 Drawing Sheets

SUSPENSION FOR A RAIL BRAKE

BACKGROUND AND SUMMARY OF THE INVENTION

The invention relates to a suspension for a rail brake on a bogie of a rail vehicle, as well as to a bogie for a rail vehicle.

Rail brake systems for rail vehicles are conventionally held on the bogie frames on both sides of a bogie. The rail brake has brake anchor plates which are provided on both sides of the wheel sets of the rail vehicle below the bogie frames. In this case, the rail brake is conventionally constructed as an electromagnetic rail brake or as an eddy current brake. Thus, the brake anchor plates may carry brake magnets on their underside, which brake magnets can be displaced by lifting devices between a lowered braking position and a lifted release position. In the lowered operative position, the brake magnets should rest on the surface of the rail or be present at a distance from the surface of the rail which is slight and as constant as possible.

In this case, the rail brakes are suspended in a pendulum fashion and designed such that they permit a lateral play of, for example, 2 to 12 mm, in the case of electromagnetic rail brakes in the low-suspension state, in order to permit a maximal overlapping between the rail brake and the rail corresponding to the axle base and the turning radius. The rail brake also has the tendency to utilize this lateral play also in the release position because accelerations occur in the bogie which, as a result of the inertia of the rail brake, are converted to pendulum movements. This may result in damage to the body.

From German Patent Document DE 197 25 174 A1, a suspension for a rail brake is known, in the case of which the lifting devices are constructed as lifting bellows which are operated pneumatically. For avoiding the pendulum movements of the rail brake in the release position and particularly in order to achieve an uncoupling of the brake with respect to the bogie and thus a positive influence on the running characteristics of the rail vehicle, a rubber layer spring is provided in this construction which centers the rail brake in the release position transversely elastically on the bogie frame. This construction was successful when active lifting devices were used.

If, in contrast, passive systems, such as pressure spring arrangements, are used for the suspension of the rail brake, problems occur in practice when a rubber layer spring is used. As a rule, such pressure spring arrangements are used for electromagnetic rail brakes in a low suspension and are configured such that, with respect to their spring force, the action of current on the electromagnets and, thus, the generating of a magnetic field is sufficient for attracting the rail brake against the force of the pressure spring to the surface of the rail. Here, the magnetic force causes an automatic centering on the rail, and the braking force is transmitted from the brake magnets by way of carriers or pull or push bows to the vehicle. When the rail brake is deactivated, it is displaced, because of the prestressing force of the pressure spring arrangement, back from the braking position into the lifted release position.

While the known centering device with the rubber layer spring in the release position is constantly prestressed by the lifting bellows against the bogie, in the case of a pressure spring arrangement, it may, however, be possible, particularly in the case of impact loads, that the centered and damped position cannot be maintained. This problem is the result of the fact that the spring force of the pressure spring arrangement is a constructively defined value, which in this case is configured such that it can be overcome by the activation of the rail brake. Thus, in the case of a pressure spring arrangement, the rail brake is not as reliably held in the release position as in the case of a spring bellows arrangement actively acted upon by compressed air. On the other hand, pressure spring arrangements are distinguished by their simple construction and ruggedness.

Furthermore, the problem of impact loads increases with the expanded usage range of these braking systems. Thus, pressure spring suspensions have so far mainly been used on streetcars, etc. which move at relatively low speeds. Now, systems of this type are to be used also in the standard gauge railway range, where speed of over 100 km/h are traveled on a regular basis. As a result, the dynamic loads on the rail brake increase significantly. While a rail brake suspended in this manner, when used in a streetcar, could still be sufficiently held also in the release position by providing carriers, so that no damage occurred to the rest of the body, this can no longer be excluded in the case of the intended increased loads.

It is therefore an object of the present invention to further develop a suspension of the above-mentioned type for a rail brake in such a manner that, also when passive lifting devices are used, the movements of the rail brake in the release position can be limited with respect to the bogie and hard impacts can be avoided and the required lateral play is nevertheless permitted in the braking position.

This object is achieved by means of a suspension for a rail brake, according to the present invention, by providing damping elements between the carriers of the bogie frame and the stoppers of the rail brake in the release position of the rail brake to damp forces transverse to the traveling direction of the rail vehicle.

Thus, it was recognized according to the invention that, as a result of astonishingly low constructional expenditures, a significantly improved suspension can be implemented for a rail brake of this type. By means of the further development according to the invention, particularly the expenditures are reduced for the constructive design of the damping elements, mainly with respect to a suitable characteristic curve of the damping characteristics. The suspension according to the invention is therefore distinguished not only by its cost-effective producibility but also by a very high reliability. The susceptibility to damage is therefore low and, by selecting a suitable material, very long service lives can be achieved. This construction is particularly suitable also for a large range of loads, so that use is also possible at very high speeds. Impacts and vibration loads can thereby be reliably absorbed without any damage to surrounding parts of the body.

While in the prior art, even a slight sagging of the rail brake under loads of this type could result in a loss of centering, this can be avoided by the suspension according to the invention because, instead of the rubber layer spring, which has a differentiated springing behavior in each layer, a compact damping element is used. As a result, a high reliability of the system can be achieved.

Because of the simple construction, it is also possible according to the invention to further develop the damping elements without any high constructive expenditures with respect to their material characteristics and dimensioning that they develop a sufficient damping effect in the release position and, in the braking position, nevertheless continue to permit the required lateral play, so that the required braking effect can fully develop, for example, when taking curves.

Advantageous further developments of the invention are as follows.

When the damping elements are arranged on the stoppers of the rail brake, existing arrangements can be retrofitted in a simple manner without requiring any changes on the bogie.

It is also advantageous, in the release position, for the stoppers to be received with a play transversely to the traveling direction in the carriers. As a result, friction forces during the movement of the rail brake from the braking position into the lifted release position can be effectively reduced or completely prevented. An exact method of operation of the rail brake can thereby be achieved in an even better fashion. Furthermore, the wear of the arrangement is reduced, which increases its durability.

As an alternative, it is also possible that, in the release position, the rail brake is centered by the damping elements in the carriers. This construction has the advantage that free movements of the rail brake are essentially completely avoided, whereby the dynamic stressing of the arrangement is further reduced.

The further development with or without play in this case depends essentially on the respective application and the given parameters, such as the desired maximal speed of the rail vehicle, etc.

When the carriers reach in a U-shape around the stoppers, in which case the damping elements are arranged on both sides on the stoppers, a reliable fixation is achieved on each carrier. The stability of the arrangement in the release position is further increased thereby.

As an alternative thereto, it is also possible to construct the carriers in an L-shape and to arrange them such that they receive the rail brake in a horizontal plane. In this case, the rail brake has at least two brake magnets which are arranged parallel to one another under the bogie frames and which are connected by way of only one anchor arm. This construction has the advantage that the carriers can have a simpler design. The degree of freedom in the case of the L-shaped embodiment, which exists in contrast to the U-shaped further development of the carriers, is in this case eliminated by the anchor arm. This prevents a tilting of the brake magnets. This arrangement is also more accessible to servicing and maintenance work.

If the damping elements in this embodiment are in each case arranged only on the side of the stoppers which are oriented to the pertaining carriers, the construction is further simplified. Furthermore, the number of parts subjected to wear can be reduced, whereby the durability of the arrangement is improved.

Because of the fact that a longitudinal damping element is arranged on the stoppers which, interacting with the carriers, damps movements in the traveling direction, an even greater reliability of the arrangement is achieved because loads, etc. in the longitudinal direction can also be reliably absorbed.

According to another aspect of the invention, a bogie for a rail vehicle is provided which contains the suspension according to the invention. By means of this bogie, improved traveling characteristics are achieved and the susceptibility to damage is simultaneously reduced. This also permits a use of such a bogie at speeds above 100 km/h.

In the following, the invention will be explained in detail in embodiments by means of the figures in the drawing.

DETAILED DESCRIPTION OF THE PREFERRED EMBODIMENTS

Figure 1:
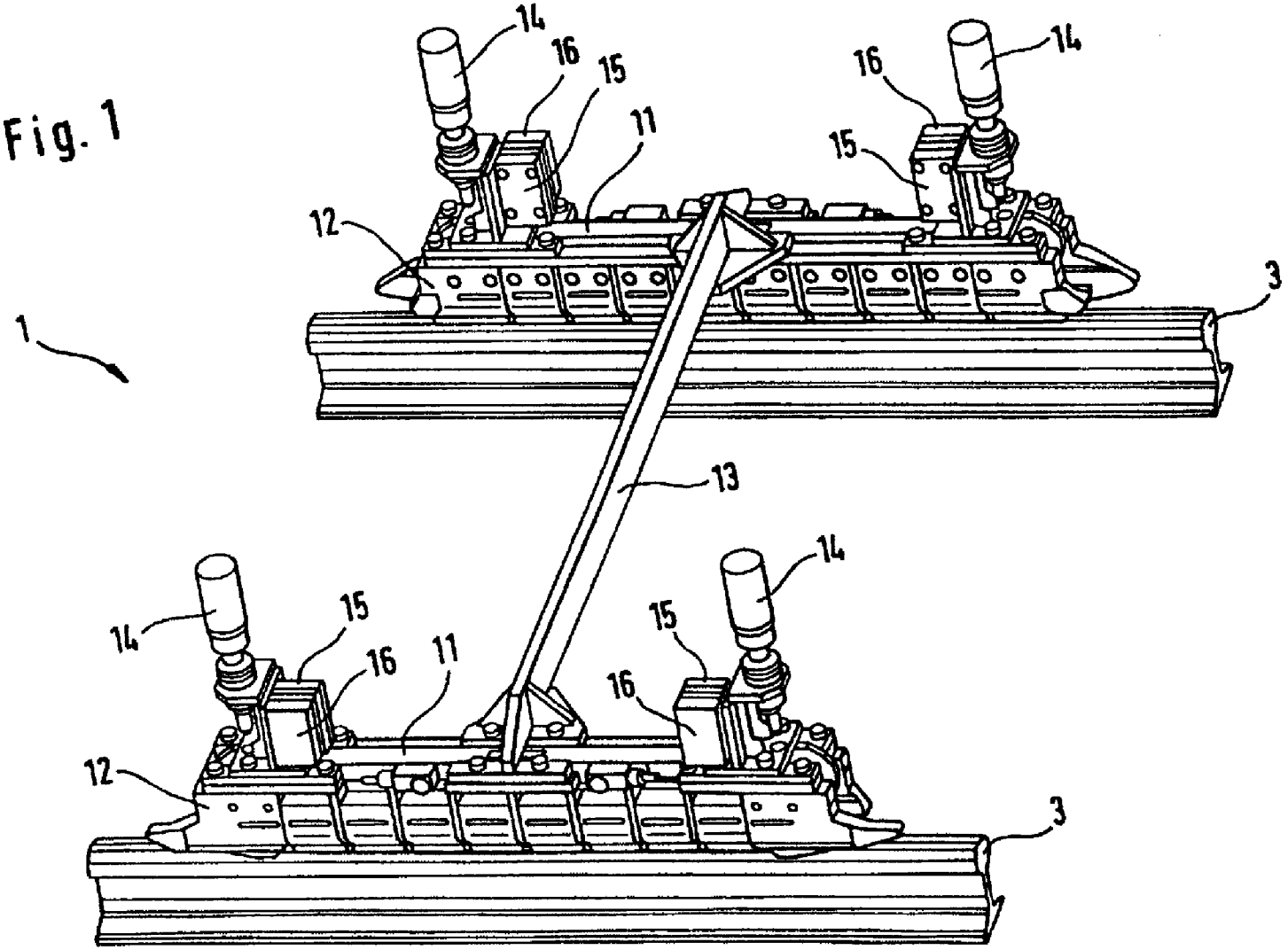
FIG. 1 is a perspective representation of the rail brake, according to the present invention, above a pair of rails, in which case the bogie of the rail vehicle was omitted for simplifying the representation.
Figure 2:
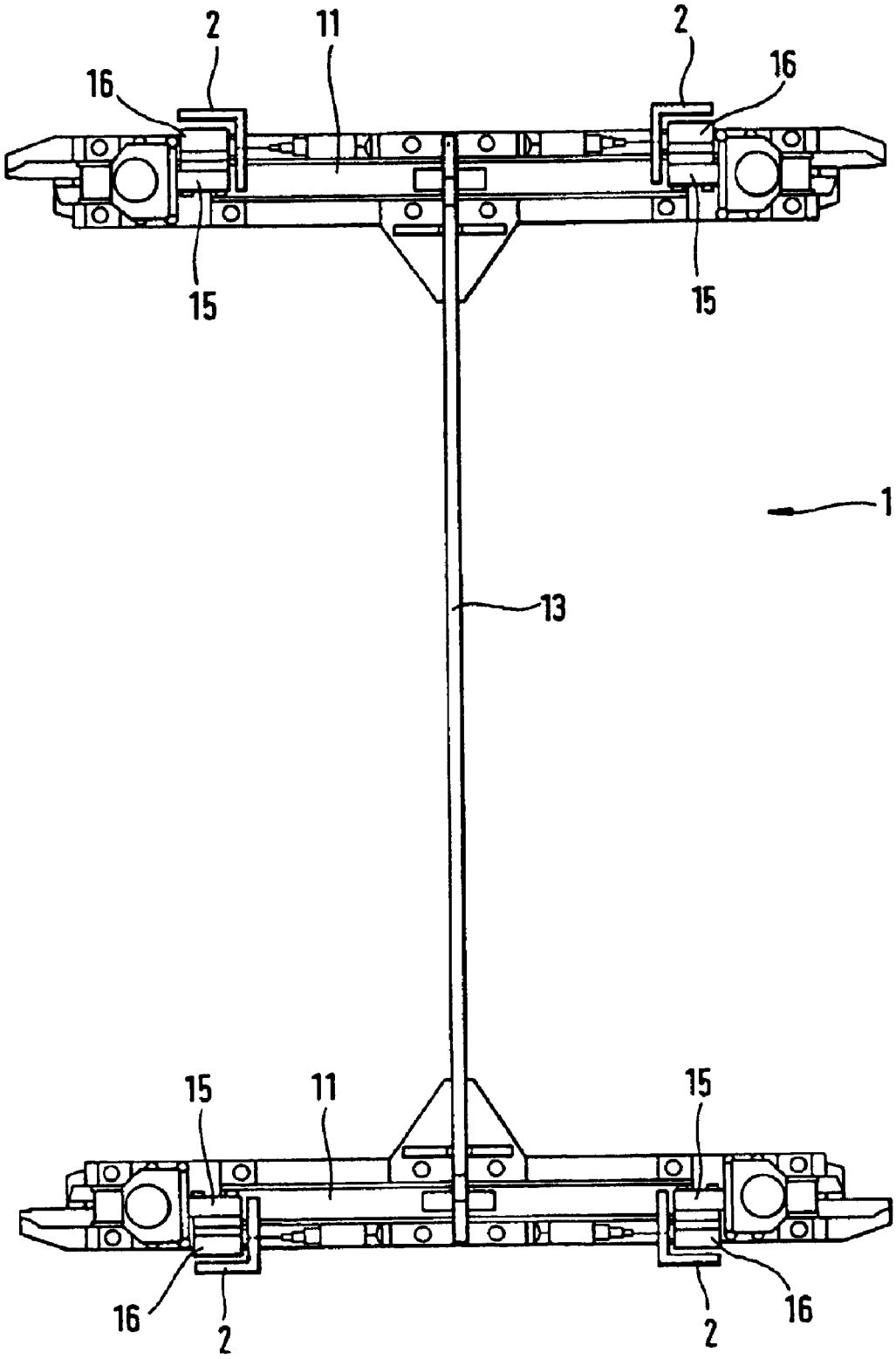
FIG. 2 is a top view of the rail brake according to the present invention which has L-shaped carriers.

FIGS. 1 and 2 illustrate a rail brake 1 according to the eddy current principle, which has two brake anchor plates 11 arranged parallel to one another and brake magnets 12 arranged underneath. The two brake anchor plates 11 are mutually connected by way of an anchor arm 13. The rail brake 1 also contains lifting devices 14 which are constructed as pressure spring devices. The lifting devices 14 are each arranged in the end area of the brake anchor plates 11.

In addition, the rail brake 1 contains stoppers 15, on which damping elements 16 are fastened on one side. FIG. 2 shows that the stoppers 15 interact with the carriers 2 by way of damping elements 16. The carriers 2 are each fastened on the bogie frame on each longitudinal side of a bogie of a rail vehicle (not shown). The carriers interacting with the stoppers 15 or damping elements 16 limit the freedom of movement of the rail brake 1 in the release position. In addition, in the braking position, the stoppers 15 or damping elements 16 permit the transmission of the braking force to the bogie. For this purpose, the carriers 2 are each constructed in an L-shape and arranged such that the rail brake 1 cannot escape in the plane of the drawing according to FIG. 2 from being surrounded by the carriers 2.

In addition, the rail brake 1 is fixed in a known manner in a pendulum-type fashion on the bogie of the rail vehicle. The devices required for this purpose are known and are not shown in the figures for simplifying the representation.

For braking the rail vehicle, the rail brake 1 is activated such that a magnetic field is generated by the brake magnets 12. This magnetic field causes a force component, by means of which the rail brake 1 is pulled down, against the effect of the pressure springs in the lifting devices 14, onto the rails 3 situated underneath. This is the braking position of the rail brake 10. The braking effect is caused by the existing attraction force as a result of the magnetic field.

For releasing the brake, the rail brake 1 is deactivated, whereby the magnetic field of the brake magnets 12 is eliminated. The rail brake 1 will then be lifted by the force of the pressure springs in the lifting devices 14 away from the rails 3 into a release position.

While, in the braking position, the rail brake 1 has to have a lateral play in order to permit, corresponding to the axle base at the bogies and the turning radius of the rails 3, a maximal overlap between the rail brake 1 and the rails 3, the lateral play should be as small as possible in the release position. This is achieved by the special development of the damping elements 16 and the interaction with the stoppers 15 and the carriers 2. The damping elements 16 therefore have elasticity characteristics which are optimized while taking into account the two individual application cases. Steel/rubber combinations are preferably used here.

As an alternative, it is possible to configure the damping elements 16 and/or the stoppers 15 or the carriers 2 such that the brake magnets center in the release position, that is, have a reduced lateral play in comparison to the braking position.

As illustrated in FIG. 2, the carriers 2 can be arranged such that they permit only a small play in a direction transverse to the traveling direction of the rail vehicle. If, in the course of the travel, vibrations or hard impacts occur, these are damped to such an extent by the damping elements 16 acting transversely to the traveling direction that surrounding components, such as the bogie frame, etc. are not damaged.

Figure 3:
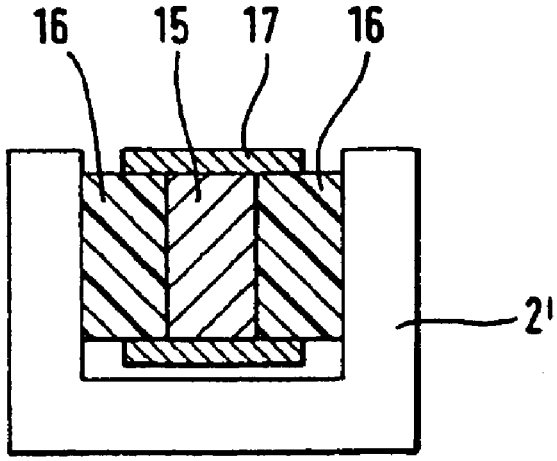
FIG. 3 is a view of another embodiment of the invention in which a U-shaped carrier is coupled without any gap with a stopper having a damping element.
Figure 4:
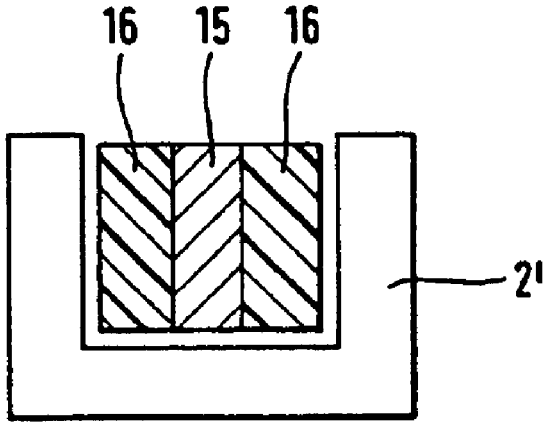
FIG. 4 is a view similar to FIG. 3, but having play between the stopper with the damping elements and the carrier.
Figure 5:
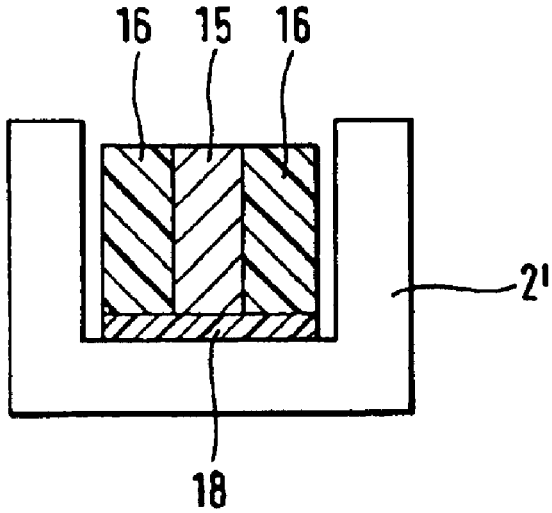
FIG. 5 is a view of another embodiment similar to FIG. 4 with a longitudinal damping element.

FIGS. 3 to 5 show further embodiments of the present invention. As illustrated by these detailed representations, carriers 2' are arranged here which have a U-shaped construction. In this case, the carriers 2' enclose the stoppers 15 on three sides, damping elements 16 being arranged in each case on both sides of the stoppers 15.

FIGS. 3 to 5 each are bottom views of an individual carrier—stopper arrangement, in which case the corresponding arrangements may exist at all four of the points or positions illustrated in FIGS. 1 and 2.

In the embodiment illustrated in FIG. 3, the interactions of these components is such that no play exists between the carrier 2' and the damping elements 16 at the stopper 15. In the case of this construction, in the release position, the rail brake 1 is therefore centered at the bogie without play. Here, insertion bevels (not shown) can be constructed at the carrier 2' which facilitate the insertion operation.

FIG. 3 also shows a fixing stopper 17 which limits the longitudinal movement of the stopper 15. However, this fixing stopper 17 is not absolutely necessary.

FIG. 4 shows an embodiment in which a play is formed between the carrier 2' and the damping elements 16. In this embodiment, the stopper 15 can be moved with less force in the carrier 2' because no friction pressure exists between the elements. In this case, the vibrations or movements of the rail brake 1 permitted by the play are absorbed and damped by the damping elements 16.

According to the representation in FIG. 5, a longitudinal damping element 18 may be arranged on the stopper 15 and is capable of absorbing impacts in the traveling direction of the rail vehicle.

The material of the damping elements 16 and 18 respectively is selected such that the desired stiffness and damping values occur in the respective load directions. In addition, certain characteristic damping curves can be adjusted in a manner known per se, so that, for example, in the starting range of their elastic deformation, the damping elements react flexibly and subsequently exhibit harder characteristic spring curves. As a result, interactions between the rail brake 1 and the bogie can be reliably avoided.

In addition to the indicated embodiments, the invention permits additional design concepts.

Thus, it is, for example, also possible to construct the stoppers 15 in an L-shape or U-shape and correspondingly construct the carriers 2 and 2' respectively in the shape of a right parallelepiped.

In addition, the present invention can also be used on electromagnetic rail brakes in which a contact occurs between the brake magnet and the rail. The magnetic force maybe generated by way of permanent as well as electromagnets. The lowering into the braking position, in the case of this construction with permanent magnets, takes place by active lifting devices.

The suspension according to the invention is particularly suitable for rail brakes in a low suspension. However, it can also be used in constructions with a high suspension or with change-over possibilities between the two.

Furthermore, the suspension can also be used on other passive lifting devices and, in addition, can be used on active lifting devices, for example, with lifting bellows, etc.

On the surfaces interacting with the carriers 2 and 2' respectively, stable plates may also be vulcanized or otherwise mounted on the damping elements. These plates reduce the wear at this point as well as the risk of damage.

In addition, it is possible for the damping elements to be fastened to the carriers.

The invention therefore provides a suspension for a rail brake 1 on a bogie of a rail vehicle, in which case a passive lifting device 14 is provided which acts upon the rail brake 1 as a function of its activation condition such that it can be displaced between a lowered braking position and a lifted release position. In the release position, damping elements 16 act between the stopper 15 of the rail brake 1 and the carriers 2, 2' of the bogie such that transverse forces, for example, as result of vibrations or impact loads, are reliably damped. In contrast, the required lateral play of the arrangement continues to be possible in the braking position.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed is:

1. A suspension for a rail brake on a bogie of a rail vehicle, comprising:

one bogie frame respectively for each longitudinal side of the bogie, and passive lifting device fixed on the bogie frames and, as a function of its activation condition, moves the rail brake between a lowered braking position and a lifted release position;

carriers on the bogie frames, being arranged to receive stoppers on the rail brake in the release position of the rail brake; and damping elements positioned between the stoppers of the rail brake and the carriers to damp forces transverse to a traveling direction of the rail vehicle occurring between the stoppers and the carriers in the release position.

2. The suspension according to claim 1, wherein the damping elements are arranged on the stoppers of the rail brake.

3. The suspension according to claim 2, wherein the stoppers in the release position are received with play transverse to the traveling direction in the carriers.

4. The suspension according to claim 2, wherein the rail brake with the stoppers in the release position is centered in the carriers by the damping elements.

5. The suspension according to claim 2, wherein the carriers are a U-shape and reach around the stoppers in the release position, and the damping elements are on both sides on the stoppers.

6. The suspension according to claim 2, wherein the carriers have an L-shaped construction and are arranged such that they receive the rail brake in a horizontal plane, the rail brake having at least two brake magnets which are arranged parallel to one another below the bogie frames and which are connected by only one anchor arm.

7. The suspension according to claim 6, wherein the damping elements are arranged only on a side of the stoppers facing toward the pertaining carriers.

8. The suspension according to claim 2, including a longitudinal damping element on the stoppers, which longitudinal damping element, interacting with the carriers, damps movements in the traveling direction.

9. A bogie for a rail vehicle, having a rail brake which is coupled to the bogie by a suspension of claim 1.

10. The suspension according to claim 1, wherein the stoppers in the release position are received with play transverse to the traveling direction in the carriers.

11. The suspension according to claim 1, wherein the rail brake with the stoppers in the release position is centered in the carriers by the damping elements.

12. The suspension according to claim 1, wherein the carriers are a U-shape and reach around the stoppers in the release position, and the damping elements are on both sides on the stoppers.

13. The suspension according to claim 1, wherein the carriers have an L-shaped construction and are arranged such that they receive the rail brake in a horizontal plane, the rail brake having at least two brake magnets which are arranged parallel to one another below the bogie frames and which are connected by only one anchor arm.

14. The suspension according to claim 13, wherein the damping elements are arranged only on a side of the stoppers facing toward the pertaining carriers.

15. The suspension according to claim 1, including a longitudinal damping element on the stoppers, which longitudinal damping element, interacting with the carriers, damps movements in the traveling direction.

16. The suspension according to claim 1, wherein the damping elements are arranged on the carriers.

17. The suspension according to claim 1, wherein the damping elements have a spring character allowing lateral play in the braking position.

* * * * *